US006476711B2

(12) United States Patent
Kitamura et al.

(10) Patent No.: US 6,476,711 B2
(45) **Date of Patent: *Nov. 5, 2002**

(54) SOUNDING-BODY DRIVING CIRCUIT AND OPERATING SOUND GENERATING APPARATUS USING THE SAME

(75) Inventors: Hajime Kitamura, Shizuoka (JP); Naohiro Fujinami, Shizuoka (JP); Katsuyoshi Omori, Shizuoka (JP)

(73) Assignee: Star Micronics Co.,Ltd., Shizuoka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/344,496

(22) Filed: Jun. 25, 1999

(65) Prior Publication Data

US 2002/0145510 A1 Oct. 10, 2002

(30) Foreign Application Priority Data

Apr. 9, 1999 (JP) ..... 11-102182

(51) Int. Cl.[7] ..... G08B 3/00

(52) U.S. Cl. ..... 340/384.7; 340/384.1; 340/384.3; 340/425

(58) Field of Search ..... 340/384.7, 384.1, 340/384.3, 384.5, 475

(56) References Cited

U.S. PATENT DOCUMENTS 4,073,133 A * 2/1978 Earls et al. ..... 340/384.1
4,350,073 A * 9/1982 Peterson ..... 84/454
4,354,415 A * 10/1982 Sonnabend ..... 381/61
4,401,975 A * 8/1983 Ferguson et al. ..... 340/384.71
5,195,920 A * 3/1993 Collier ..... 446/409
5,455,558 A * 10/1995 Gregory ..... 340/474
5,523,738 A * 6/1996 Fuller ..... 340/475
5,699,420 A * 12/1997 Michel ..... 379/373
5,964,054 A * 10/1999 Galfidi, Jr. ..... 446/397

FOREIGN PATENT DOCUMENTS

JP 59-102448 7/1984
JP 4-136948 12/1992

* cited by examiner

*Primary Examiner*—Nina Tong
(74) *Attorney, Agent, or Firm*—Wenderoth, Lind & Ponack, L.L.P.

(57) ABSTRACT

Upon receipt of a direction indication control signal s11, a sounding-body driving circuit 12 generates a driving signal s16 for generating a flashing operation sound which is an artificial striking sound similar to a striking sound of a mechanical relay. The driving signal s16 is output to a speaker 16 via an amplifier 14, and the flashing operation sound is outputted from the speaker 16, thereby obtaining the flashing operation sound which does not sound unusual to the driver. The sounding-body driving circuit 12 enables a plurality of rectangular wave signals having the same amplitude and different frequencies to be synthesized in sequence of time by first and second synthetic signal generating circuits 20A and 20B to thus generate first and second synthetic signals s14 and s15 as artificial striking sounds.

24 Claims, 10 Drawing Sheets

SOUNDING-BODY DRIVING CIRCUIT AND OPERATING SOUND GENERATING APPARATUS USING THE SAME

BACKGROUND OF THE INVENTION

1. Field of the Invention

The present invention relates to a sounding-body driving circuit outputting to a sounding body a drive signal for generating an artificial striking sound similar to a striking sound of a mechanical relay, and to an operating-sound generating apparatus using the circuit.

2. Description of the Related Art

A direction indicating apparatus of a vehicle generally has a mechanical relay for flashing a turn signal indicator, which is flashed by the mechanical relay in accordance with operation of a turn signal lever. Further, a driver of the vehicle can recognize that the turn signal indicator is in a state of flashing by means of both a visual warning of the flashing display of the indicator and an audio warning of the striking sound of the mechanical relay.

The mechanical relay is generally disposed near the driver's seat so that the driver can hear the string sound. In the case where the mechanical relay is miniaturized, or disposed in the engine room for circuit construction reasons, it becomes hard for the driver to hear the striking sound of the mechanical relay. Furthermore, when the flashing operation of the turn signal indicator is performed using a semiconductor switch and the like, the mechanical relay itself is unnecessary, so that the striking sound of the mechanical relay is not generated.

On the other hand, as disclosed in Japanese Unexamined Utility Model Publications JP-U 59-102448(1984) and JP-U 4-136948(1992), in the case of adopting such a construction that a sounding body such as a piezoelectric buzzer or a speaker is used and driven to generate a sound synchronized with the flashing operation of the turn signal indicator, the flashing operation state of the turn signal indicator can be indicated auditorially to the driver without the striking sound of the mechanical relay.

However, since the striking sound of the mechanical relay has been used for a long time as a flashing operation sound of the turn signal indicator, drivers are accustomed to such a tone. Accordingly, in the case where a sound different from a striking sound is generated as a flashing operation sound from the sounding body, as disclosed in the publications, the drivers have an undesireable unusual feeling because the flashing operation sound is fairly different in tone from the accustomed striking sound of the mechanical relay.

In the case of reproducing the striking sound of the mechanical relay faithfully, as shown in FIG. 9, it is necessary to generate a driving signal having an irregular waveform 4 showing a complicated envelop 2. There is consequently a problem such that the driving circuit is complicated and expensive.

SUMMARY OF THE INVENTION

It is an object of the invention to provide a sounding-body driving circuit and operation sound generating apparatus which allows generation of a flashing operation sound of a turn signal indicator with a simple and low-cost construction without presenting an unusual feeling to a vehicle driver.

Even if the striking sound of a mechanical relay is not reproduced faithfully, when an artificial striking sound similar to the striking sound is obtained as the flashing operation sound of the turn signal indicator, the driver has no unusual feeling toward the artificial striking sound. Thus, the object of the invention is achieved by adopting a driving circuit for generating the artificial string sound and putting some constructional thought into designing the driving circuit.

According to the invention, there is provided a sounding-body driving circuit outputting to a sounding body a driving signal for generating an artificial string sound similar to a striking sound of a mechanical relay. The sounding-body driving circuit generates a plurality of signals having different frequencies, synthesizes the plurality of signals in sequence of time, and repeatedly outputs the generated synthetic signal at intervals of a predetermined time.

No restriction is placed on the plurality of signals with respect to frequency, waveform, amplitude etc. as long as they are different in frequency. For example, with respect to waveform, any wave such as a rectangular wave, sine wave, triangular wave or the like may be used. With respect to amplitude, a constant value may be set or different values may be set at random or according to differences in frequency between the signals.

There is no particular restriction on the specific method of synthesizing the plurality of signals in sequence of time (e.g., order of synthesis of the signals, wave number of each signal, or method of combining the signals).

The synthetic signal denotes a signal obtained by connecting in sequence of time at least two kinds of signals of different frequencies. A synthetic signal may be generated by forming two or more kinds of signals of frequencies by a single oscillation circuit and connecting the signals in sequence of time.

As shown in the construction mentioned above, the sounding-body driving circuit according to the invention outputs the driving signal for generating an artificial striking signal to the sounding body. Since the plurality of signals having different frequencies are generated and synthesized in sequence of time and the synthetic signal thus generated is repeatedly outputted at intervals of a predetermined time, the following effects can be obtained.

Various tones can be obtained by synthesizing a plurality of signals having different frequencies, such various tones cannot be obtained by signals of a single frequency. The synthesis is performed in sequence of time so that the plurality of signals are properly arranged to generate a synthetic signal and the synthetic signal is outputted to the sounding body, thereby realizing an artificial string sound similar to the striking sound of the mechanical relay. Moreover, since the synthetic signal is repeatedly outputted at intervals of a predetermined time, by adjusting the predetermined time to a proper value, not only the tone of the artificial striking sound but also the generation interval can be made similar to those of the flashing operation sound of the turn signal indicator, that is, the striking sound of the mechanical relay.

According to the invention, a plurality of signals having different frequencies are generated and synthesized in sequence of time (that is, simply connected based time), thereby realizing an artificial striking sound similar to the striking sound of the mechanical relay with a simple and low-cost construction. By repeatedly outputting the synthetic signal at intervals of a predetermined time, the flashing operation sound of a turn signal indicator which does not sound unusual to the driver can be obtained.

Although there is no specific restriction on the duration of the synthetic signal of the invention, since the duration of the striking sound of the mechanical relay is about 12 ms, it is preferable to set the duration to 12 ms or less, more preferably 6 ms or less. It is generally said in connection with the sense of hearing of humans that a duration of 1 ms or more is necessary to identify the tone of the sound, a duration of 10 ms or more to have sequential feeling, and a duration of 100 ms or more to perceive the order of time. When the duration of the synthetic signal is set to be longer than required, the sound becomes similar to an electronic sound rather than similar to the striking sound of the mechanical relay. It is preferable to set the duration of the synthetic signal rather short to such an extent that the sequential feeling of the sound is not perceived.

As long as the sounding-body driving circuit is constructed to generate a plurality of signals having different frequencies, to synthesize the plurality of signals in sequence of time, and to repeatedly output the generated synthetic signal at intervals of a predetermined time, the signal process may be performed in a software or hardware manner. A specific construction of the latter manner is, for example, a construction comprising a signal generating circuit for generating a plurality of signals having different frequencies, a signal synthesizing circuit for synthesizing the plurality of signals generated by the signal generating circuit in sequence of time, and a synthetic signal output circuit for repeatedly outputting the synthetic signals generated by the signal synthesizing circuit at intervals of a predetermined time.

In the construction mentioned above, by generating two kinds of synthetic signals and alternately outputting them, the following effects can be obtained.

In general there are two kinds of striking sounds of the mechanical relay. One striking sound generates when the movable piece of the mechanical relay comes into contact with the iron core and the other striking sound generates when the movable piece comes into contact with a contact point. The two kinds of striking sounds are alternately generated to make the flashing operation sound of the turn signal indicator of a vehicle. It is therefore preferable to make the artificial sounds similar to the two kinds of striking sounds. When the two kinds of synthetic signals are generated and alternately outputted, an artificial striking sound can be generated at the tone similar to the flashing operation sound which is an actual striking sound of the mechanical relay.

In this case, as long as the two kinds of synthetic signals are different from each other, there is no specific restriction on their construction. For example, a plurality of signals constructing the synthetic signal may be different in only any one of frequency component, duration and amplitude or two or three thereof.

Although the sounding-body driving circuit according to the invention has a construction suitable for obtaining the flashing operation sound of a turn signal indicator of a vehicle as mentioned above, there is no restriction on the circuit in respect of use. The circuit can be generally used for the case where it is necessary or preferable to generate an artificial striking sound similar to the striking sound of the mechanical relay.

In a use other than the use of obtaining the flashing operation sound, there may be a case where the synthetic signal does not have to be repeatedly outputted at intervals of a predetermined time. From this point of view, a sufficient technical value can also be found in the construction as the sounding-body driving signal generating circuit for generating a plurality of signals having different frequencies and synthesizing the plurality of signal in sequence of time. That is, the sounding-body driving signal for generating the artificial striking sound similar to the striking sound of the mechanical relay can be obtained by the synthetic signal generated by the sounding-body driving signal generating circuit. Therefore, when the sounding-body driving signal is outputted to the sounding body at proper timing, an artificial striking sound adapted to the generation pattern of the striking sound of the mechanical relay used for various uses can be generated.

On the other hand, when the sounding-body driving circuit according to the invention is constructed as a part of the operating-sound generating apparatus of the turn signal indicator, the synthetic signal is outputted synchronously with the timing of the turn-on and turn-off of the turn signal indicator. The artificial striking sound can be generated at the same timing as the generation timing of the flashing operation sound which is the striking sound of the mechanical relay, so that the possibility of the driver thinking the sound is unusual can be more effectively prevented.

When the sounding-body driving circuit is constructed as a part of the operation sound generating apparatus of the turn signal indicator, by generating two kinds of signals and alternately outputting the two kinds of signals synchronously with the timing of the turn-on and turn-off of the turn signal indicator, a flashing operation sound of the turn signal indicator which does not sound unusual to the driver can be obtained.

By alternately outputting the two kinds of signals, two kinds of artificial striking sounds are alternately generated from the sounding body. Even if each artificial striking sound itself is not similar to the striking sound of the mechanical relay, a synthetic signal obtained by synthesizing a plurality of signals having different frequencies is not used as the driving signal and the generation pattern of the artificial striking sound is the same as that of the flashing operation sound of the turn signal indicator by the striking sound of the mechanical relay. Therefore, the flashing operation sound of the turn signal indicator can be prevented from sounding to the driver. By adopting such a construction, the sounding-body driving circuit can be constructed simpler at lower cost.

In the operation sound generating apparatus of the turn signal indicator having the sounding-body drive circuit and the sounding body, the flashing operation sound of the turn signal indicator which does not sound unusual to the driver can be obtained as mentioned above. Using the sounding body of the operation sound generating apparatus, sounds other than the flashing operation sound can be also generated. That is, by adding proper driving means, the function of warning of a failure in the direction indicating apparatus (for example, burn-out of a bulb in the turn signal indicator), a failure in other apparatuses mounted on the vehicle, and the like can be provided.

BRIEF DESCRIPTION OF THE DRAWINGS

Further objects, features, and advantages of the invention will be more explicit from the following detailed description taken with reference to the drawings, wherein.

DETAILED DESCRIPTION OF THE PREFERRED EMBODIMENTS

Figure 1:
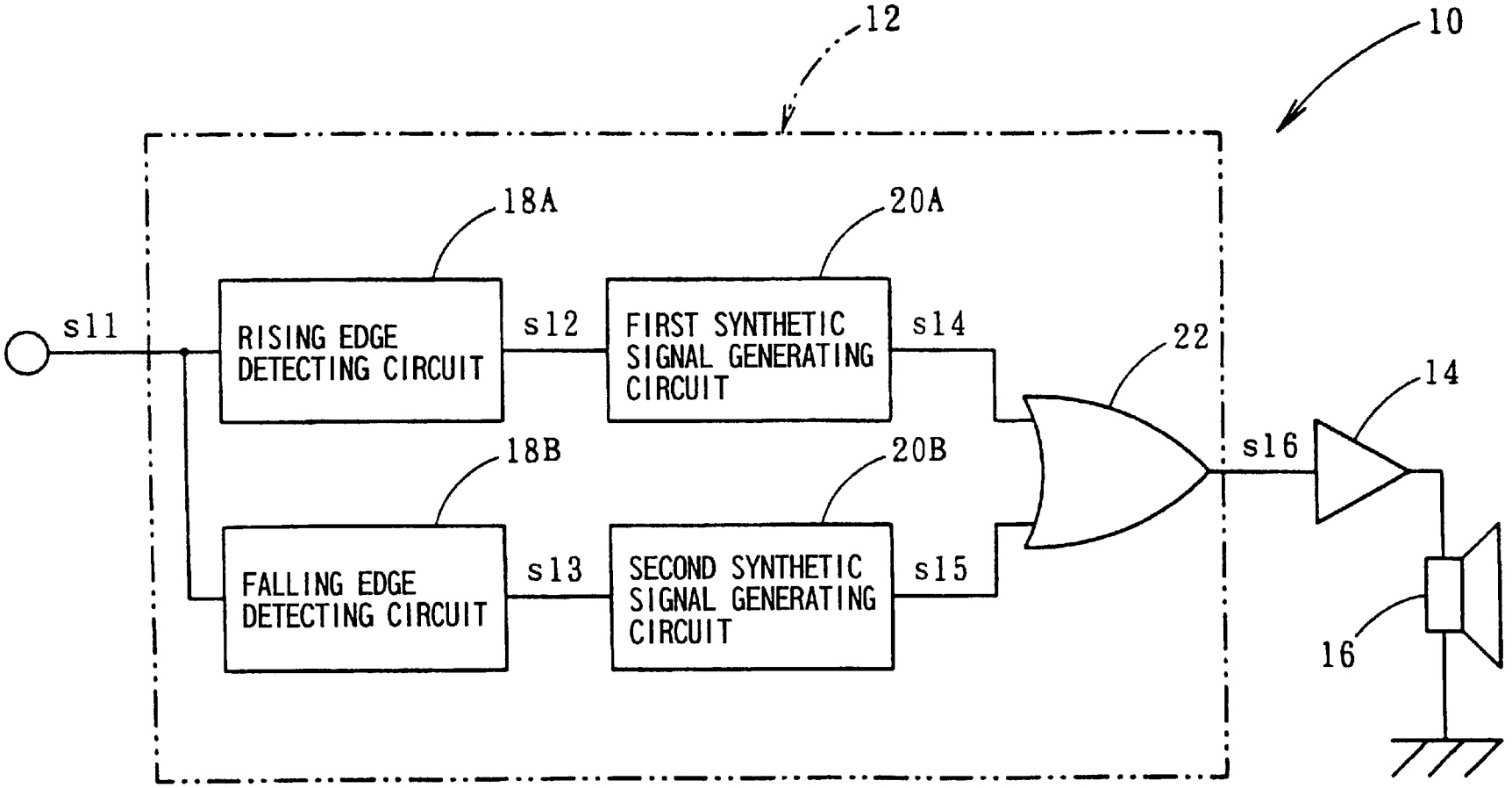
FIG. 1 is a block diagram showing an operation sound generating apparatus according to an embodiment of the invention.

Now referring to the drawings, preferred embodiments of the invention are described below.

FIG. 1 is a block diagram showing an operation sound generating apparatus 10 according to an embodiment of the invention.

The operation sound generating apparatus 10 forms a part of a direction indicating apparatus of a vehicle and comprises a sounding-body driving circuit 12, an amplifier 14, and a speaker 16 (sounding body). The operation sound generating apparatus 10 repeatedly generates an artificial striking sound similar to the striking sound of the mechanical relay at intervals of a predetermined time, as a flashing operation sound of the turn signal indicator.

More specifically, in the operation sound generating apparatus 10, a direction indication control signal s11 for making a turn signal indicator (not shown) flash is supplied to the sounding-body driving circuit 12. A driving signal s16 for producing the flashing operation sound is generated by the sounding-body driving circuit 12 and is outputted to the amplifier 14. The driving signal s16 is power-amplified by the amplifier 14 and the amplified signal is outputted to the speaker 16. The flashing operation sound is outputted from the speaker 16.

The sounding-body driving circuit 12 comprises a leading edge detecting circuit 18A and a trailing edge detecting circuit 18B disposed in parallel, a first and a second synthetic signal generating circuit 20A and 20B connected to the detecting circuits 18A and 18B, respectively, and a synthetic signal output circuit 22 connected to the first and second synthetic signal generating circuits 20A and 20B.

Figure 2:
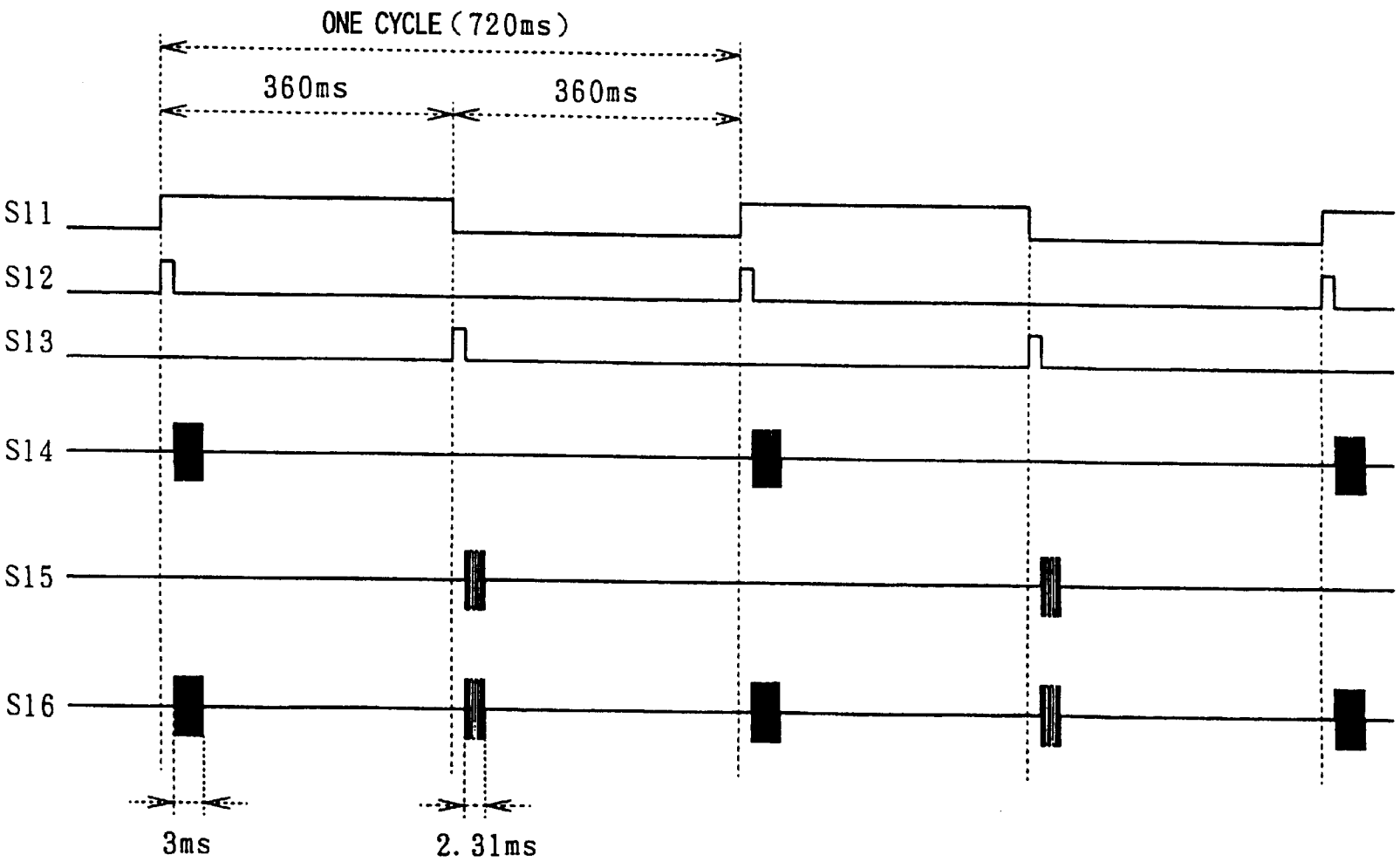
FIG. 2 is a time chart showing the operation of a sounding-body driving circuit in the operation sound generating apparatus.

A specific construction of the sounding-body driving circuit 12 will now be described according to the time chart shown in FIG. 2.

The direction indication control signal s11 is supplied to the leading edge detecting circuit 18A and the trailing edge detecting circuit 18B. The direction indication control signal s11 is a binary signal in which on-time of 360 ms and off-time of 360 ms are repeated and the turn signal indicator is turned on in on-time. The leading edge detecting circuit 18A detects the timing of the leading edge of the direction indication control signal s11, generates a first rectangular pulse signal s12 having a narrow pulse width at the leading edge tiling point, and outputs the signal s12 to the first synthetic signal generating circuit 20A. On the other hand, the trailing edge detecting circuit 18B detects the timing of the trailing edge of the direction indication control signal s11, generates a second rectangular pulse signal s13 having a narrow pulse width at the trailing edge timing point, and outputs the signal s13 to the second synthetic signal generating circuit 20B.

The first synthetic signal generating circuit 20A generates a first synthetic signal s14 (which will be described hereinlater) at the trailing edge timing point of the first rectangular pulse signal s12 and outputs the signal s14 to the synthetic signal output circuit 22. On the other hand, the second synthetic signal generating circuit 20B generates a second synthetic signal s15 (which will be described hereinlater) at the trailing edge timing point of the second rectangular pulse signal s13 and outputs the signal s13 to the synthetic signal output circuit 22.

The synthetic signal output circuit 22 adds the first and second synthetic signals s14 and s15 supplied from the first and second synthetic signal generating circuits 20A and 20B and outputs the calculation result as the drive signal s16 to the amplifier 14. The driving signal s16 is an intermittent signal such that the first and second synthetic signals s14 and s15 are alternately repeatedly outputted synchronously with timing of the turn-on and the turn-off of the turn signal indicator. There is no signal between the first and second synthetic signals s14 and s15. The reason why the first and second synthetic signals s14 and s15 are alternately outputted as the driving signals s16 is to obtain a flashing operation sound comprised of artificial striking sounds similar to two kinds of striking sounds (that is, a striking sound when a movable piece comes into contact with an iron core and a striking sound when the movable piece comes into contact with the contact point) generated by the mechanical relay.

Figure 3:
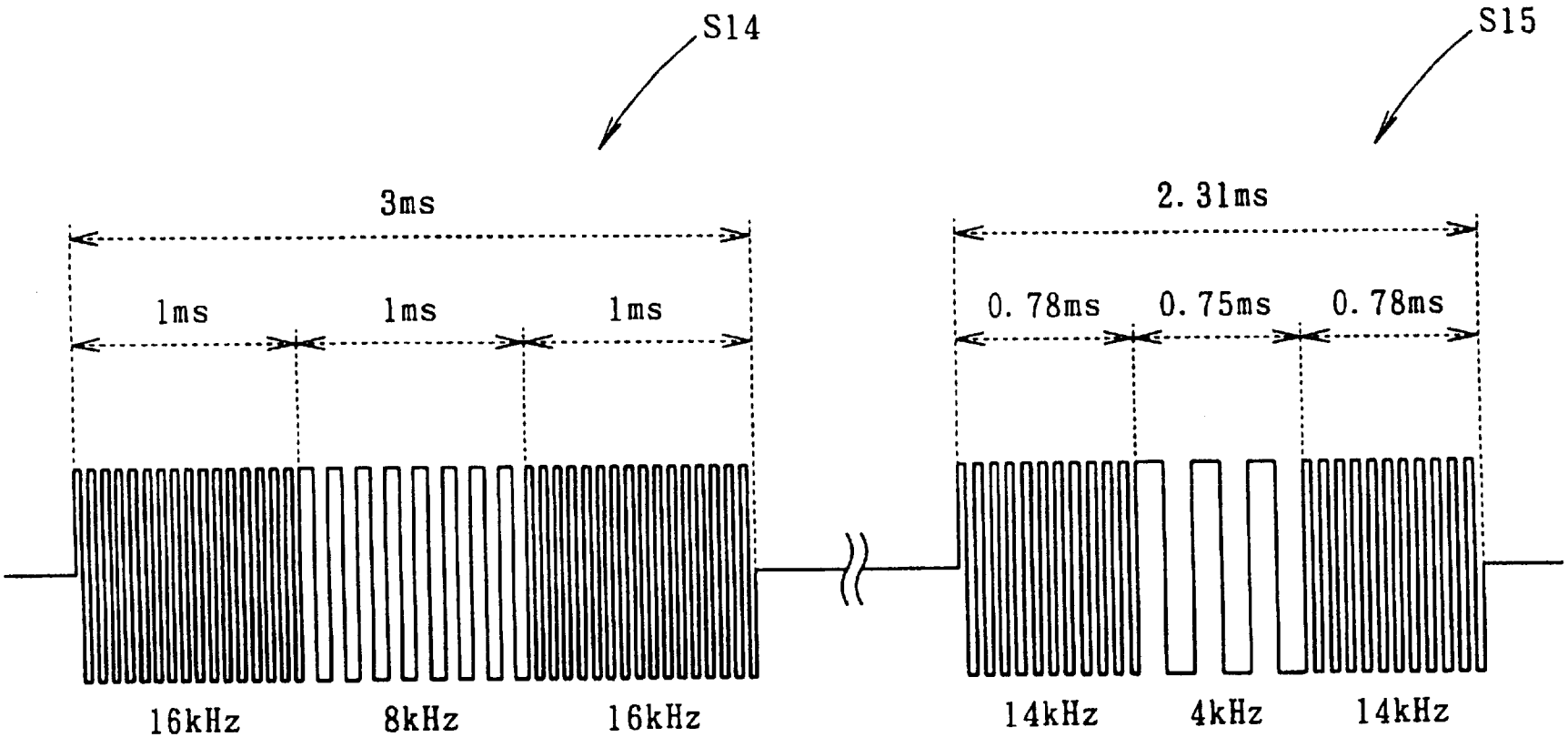
FIG. 3 is a diagram showing waveforms of first and second synthetic signals generated by first and second synthetic signal generating circuits in the sounding-body driving circuit.

FIG. 3 shows the waveforms of the first and second synthetic signals s14 and s15.

Figure 4:
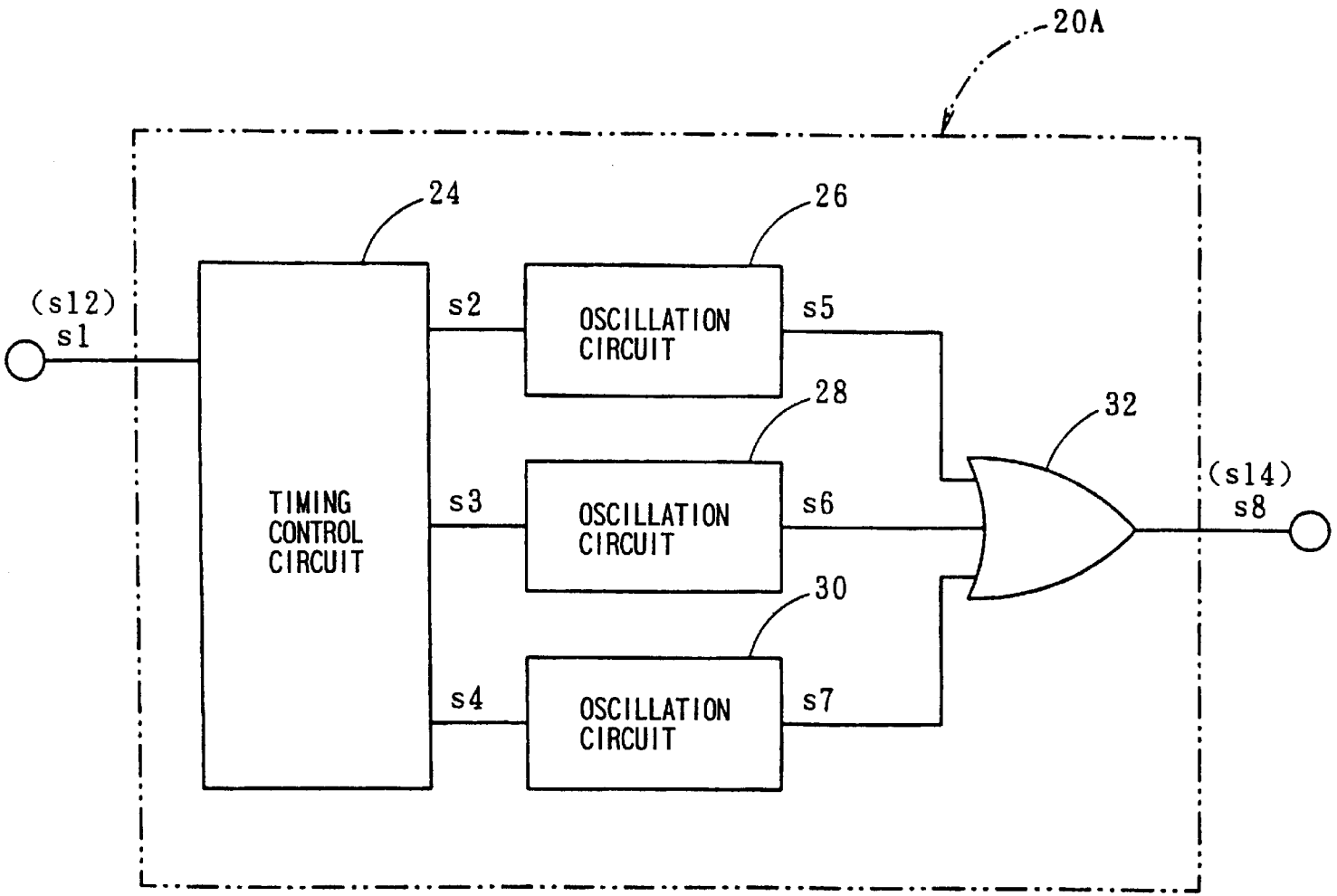
FIG. 4 is a block diagram showing the construction of the first synthetic signal generating circuit.

As shown in the diagram, each of the first and second synthetic signals s14 and s15 is obtained by synthesizing a plurality of rectangular wave signals having the same amplitude and different frequencies in sequence of time (i.e., sequentially over a continuous period of time). The duration of each of the signals s14 and s15 is set to a very short value. Specifically, the first synthetic signal s14 is a signal whose duration is 3 ms in which rectangular wave signals having a frequency of 16 kHz, rectangular wave signals having a frequency of 8 kHz, and rectangular wave signals having a frequency of 16 kHz each having the duration of 1 ms are successively simply connected on the time base (i.e., sequentially connected over a continuous period of time) as shown in FIG. 4. On the other hand, the second synthetic signal s15 is a signal whose duration is 2.31 ms in which rectangular wave signals having a frequency of 14 kHz, rectangular wave signals having a frequency of 4 kHz, and rectangular wave signals having a frequency of 14 kHz whose durations are 0.78 ms, 0.75 ms, and 0.78 ms, respectively, are successively simply connected on the time base (i.e., sequentially connected over a continuous period of time). The duration of the rectangular wave signal constructing each synthetic signal is set to a very short time so that the human ear cannot identify the rectangular wave signals as different sounds. As a result, they are recognized as a single sound by the human ear.

Since the constructions of the first and second synthetic signal generating circuits 20A and 20B for generating the first and second synthetic signals s14 and s15 are substantially the same, only the construction of the first synthetic signal generating circuit 20A will be described specifically.

Figure 5:
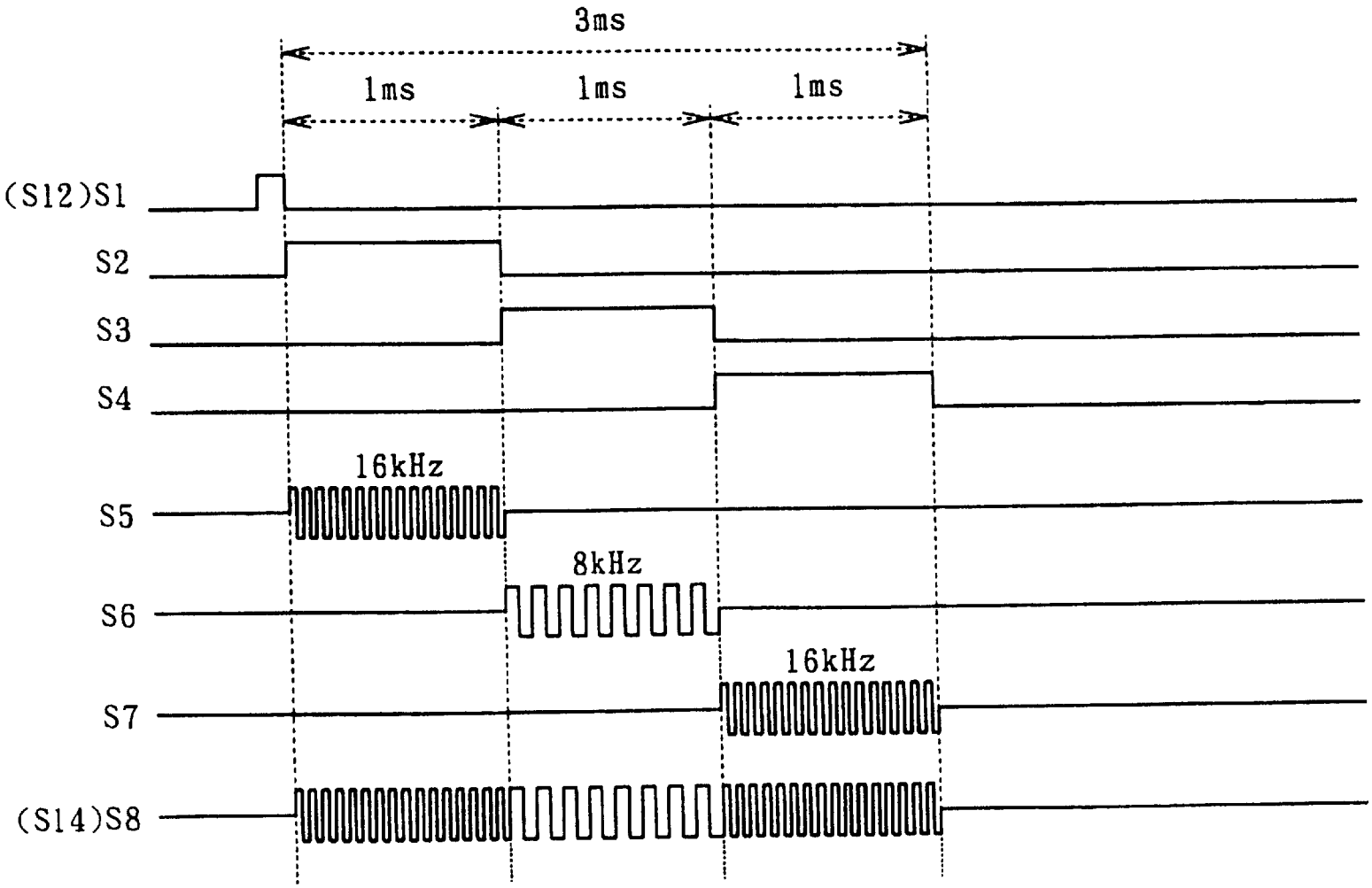
FIG. 5 is a time chart showing the operation of the first synthetic signal generating circuit.

FIG. 4 is a block diagram showing the construction of the first synthetic signal generating circuit 20A, and FIG. 5 is a time chart showing the operation of the circuit 20A.

As shown in FIG. 4, the first synthetic signal generating circuit 20A comprises a timing control circuit 24, three oscillation circuits (signal generating circuits) 26, 28, and 30, and a signal synthesizing circuit 32.

The timing control circuit 24 generates trigger signals s2, s3, and s4 to operate the oscillation circuits 26, 28, and 30 on the basis of the inputted rectangular pulse signal s1 (that is, the rectangular pulse signal s12 supplied from the leading edge detecting circuit 18A) and outputs the trigger signals s2, s3, and s4 to the oscillation circuits 26, 28, and 30, respectively. The trigger signal s2 is a rectangular pulse signal having the pulse width of 1 ms generated at the trailing edge timing point of the rectangular pulse signal s1. The trigger signal s3 is a rectangular pulse signal having the pulse width of 1 ms generated at the trailing edge timing point of the rectangular pulse signal s2. The trigger signal s4 is a rectangular pulse signal having the pulse width of 1 ms generated at the trailing edge timing point of the rectangular pulse signal s3.

The oscillation circuit 26 oscillates a first rectangular wave signal s5 having a frequency of 16 kHz for the period of the pulse width 1 ms of the trigger signal s2 by the input of the trigger signal s2. The oscillation circuit 28 oscillates a second rectangular wave signal s6 having a frequency of 8 kHz for the period of the pulse width 1 ms of the trigger signal s3 by the input of the trigger signal s3. The oscillation circuit 30 oscillates a third rectangular wave signal s6 having a frequency of 16 kHz for the period of the pulse width 1 ms of the trigger signal s4 by the input of the trigger signal s4.

The signal synthesizing circuit 32 adds the rectangular wave signals s5, s6, and s7 supplied from the three oscillation circuits 26, 28, and 30, generates a synthetic signal s8 (that is, the first synthetic signal s14) as a calculation result, and outputs the synthetic signal s8 to the synthetic signal output circuit 22.

On the other hand, the second synthetic signal generating circuit 20B has the same construction as that of the first synthetic signal generating circuit 20A except for the pulse widths of the trigger signals s2, s3, and s4 generated by the timing control circuit 24 and the oscillation frequencies of the oscillation circuits 26, 28, and 30.

Figure 6A:
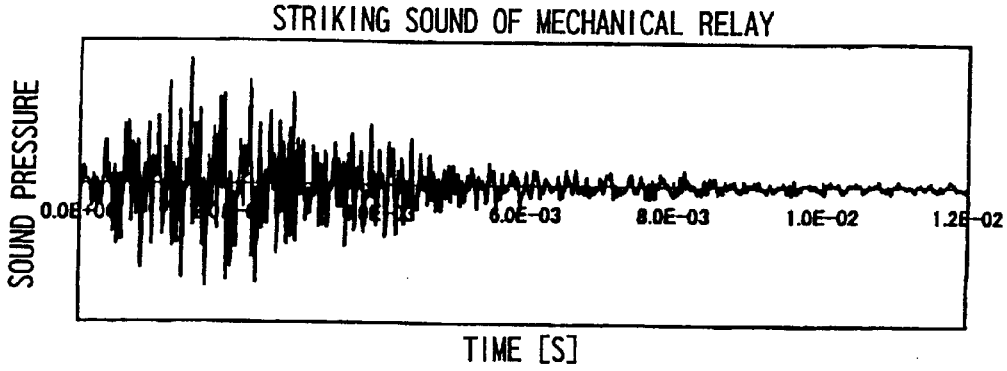
FIGS. 6A to 6C are waveform charts showing waveform data of a striking sound of a mechanical relay and an artificial string sound which were actually measured together with the waveform of an artificial striking sound driving signal on the same time base.
Figure 6B:
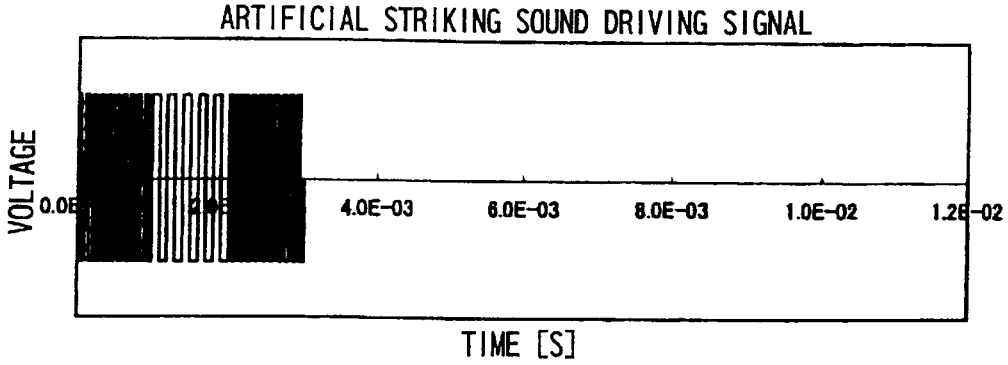
Figure 6C:
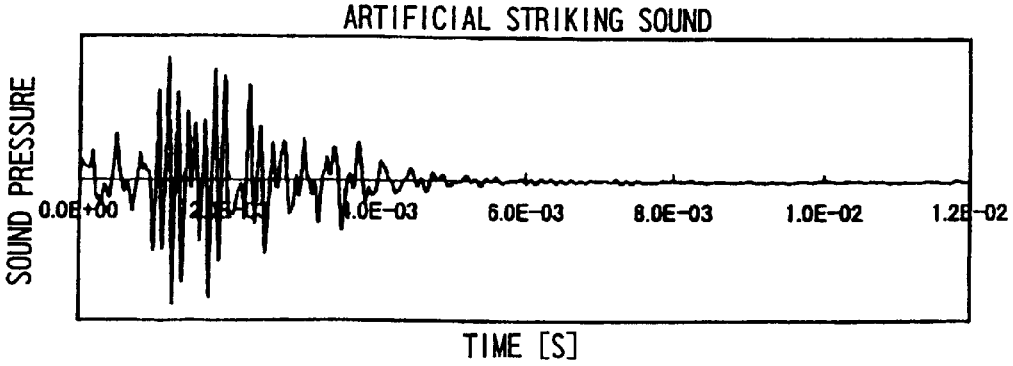

FIGS. 6A to 6C are waveform charts showing waveform data of the striking sound of the mechanical relay and an artificial striking sound which were actually measured together with the waveform of a driving signal (artificial striking sound driving signal) for generating an artificial striking sound on the same time base. One scale of the time base is 2 ms.

Figure 6D:
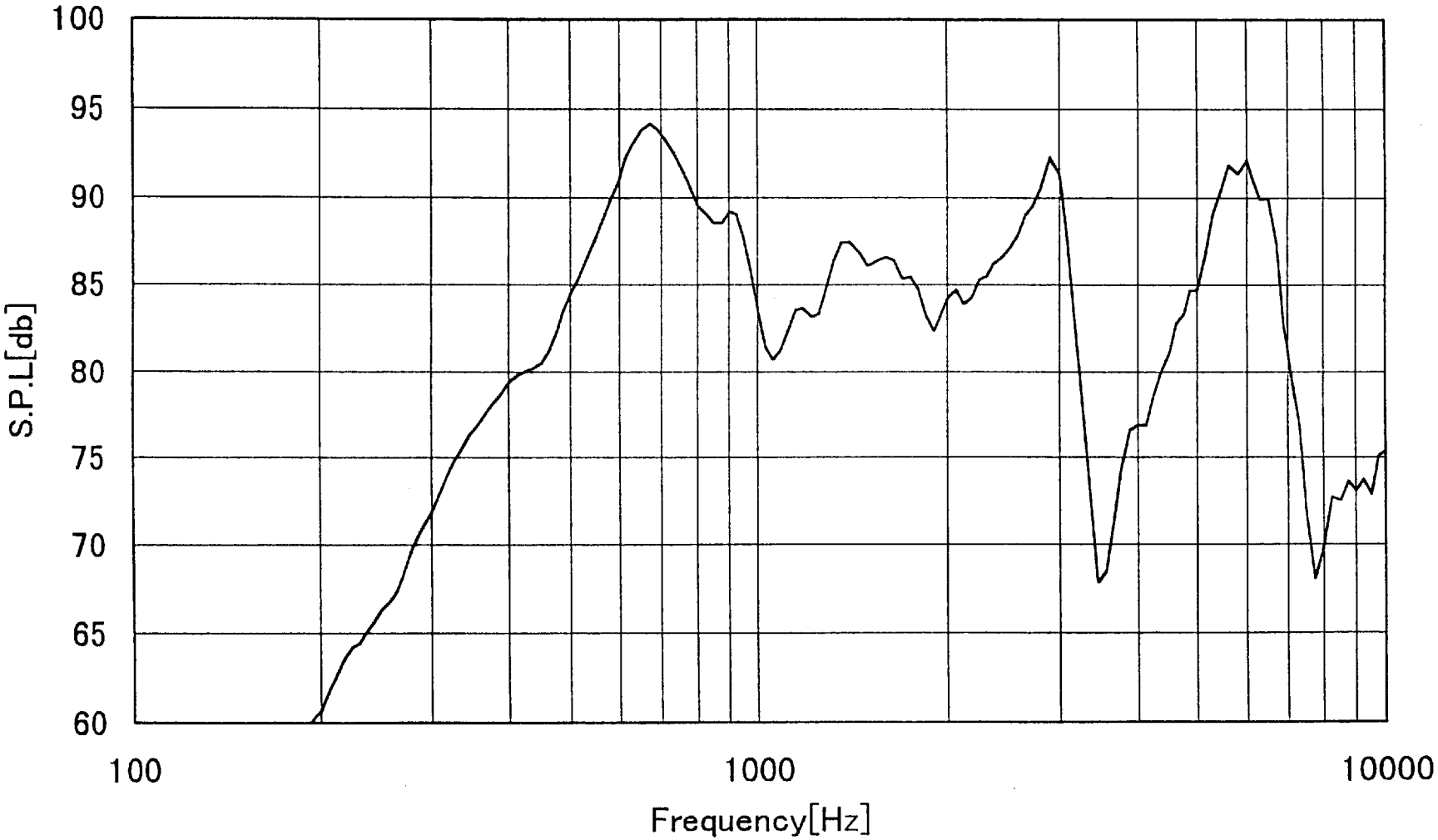
FIG. 6D is a graph showing the frequency characteristics of a speaker which generated the artificial striking sound illustrated in FIG. 6C.

The waveform data shown in FIG. 6A is waveform data obtained through a microphone by actually operating the direction indicating apparatus of a vehicle to generate a flashing operation sound of the turn signal indicator and acquiring one of two kinds of striking sounds generated by a mechanical relay. The waveform shown in FIG. 6B is a waveform of the artificial striking sound driving signal (in this case, the synthetic signal s8 is used) produced to generate an artificial striking sound similar to the actual striking sound. The waveform data shown in FIG. 6C is waveform data obtained through a microphone from an artificial striking sound generated from the speaker 16 by the artificial striking sound driving signal. The speaker 16 used for an experiment is a dynamic microspeaker having an rated input of 0.2W and its diaphragm, made of a Mylar film material, has the diameter of 28 mm. The frequency characteristics are shown in FIG. 6D. The vertical axis denotes a sound pressure level (dB) and the lateral axis denotes the logarithm of the frequency.

As illustrated, the waveform of the artificial striking sound can be made quite similar to that of the striking sound of the mechanical relay, using the synthetic signal s8 as an artificial striking sound driving signal. In this case, by setting the composition of the artificial striking sound driving signal in consideration of the frequency characteristics and the mechanical attenuation characteristics peculiar to the speaker 16, the waveform of the artificial striking sound can be made similar to that of the striking sound of the mechanical relay. For a speaker different in characteristics, it is sufficient to properly change the composition of the artificial striking sound driving signal in accordance with the characteristics of the speaker.

As described specifically above, the operation sound generating apparatus 10 according to the embodiment is constructed so that the driving signal s16 for generating the flashing operation sound which is an artificial striking sound similar to the striking sound of the mechanical relay is generated by the sounding-body driving circuit 12. The driving signal s16 is repeatedly outputted to the speaker 16 via the amplifier 14 at intervals of a predetermined time. Consequently, the flashing operation sound of the turn signal indicator which does not sound unusual to the driver can be obtained.

Moreover, since the driving signal s16 from the sounding-body driving circuit 12 is outputted by alternately outputting the first and second synthetic signals s14 and s15 having different frequency components generated by the first and second synthetic signal generating circuits 20A and 20B, the artificial striking sounds similar to the two kinds of striking sounds generated by the mechanical relay can be generated. Thus, the flashing operation sound comprised of the artificial striking sounds of the tone which is closer to the striking sound of the mechanical relay can be obtained.

Further, since the first and second synthetic signals s14 and s15 are generated synchronously with the direction indication control signals s11 from the leading edge detecting circuit 18A and the trailing edge detecting circuit 18B, the interval of generation of the artificial striking sounds can be made the same as that of the flashing operation sounds of the turn signal indicator, which is the striking sound of the mechanical relay. Consequently, the striking sound can be prevented from sounding unusual to the driver.

Since the first and second synthetic signal generating circuits 20A and 20B generate the first and second synthetic signals s14 and s15 by synthesizing a plurality of rectangular wave signals having the same amplitude and different frequencies in sequence of time, the artificial striking sound can be obtained with a simple and inexpensive construction. Moreover, due to the harmonic components included in the plurality of rectangular wave signals, the artificial striking sound can be made to sound even closer to the striking sound of the mechanical relay having wide-ranged frequency components. The driving signal s16 generated as mentioned above was supplied to the speaker 16 and its sound was compared with the actual relay operation sound of the direction indicator of a vehicle. As a comparison result by ten persons, all of them determined that the sounds are quite similar.

Although the sounding-body driving circuit 12 generates and outputs the driving signal s16 by the hardware construction in the embodiment, the driving signal s16 may be also generated and outputted by a software control using a microcomputer or the like.

Figures 7A, 7B, 7C:
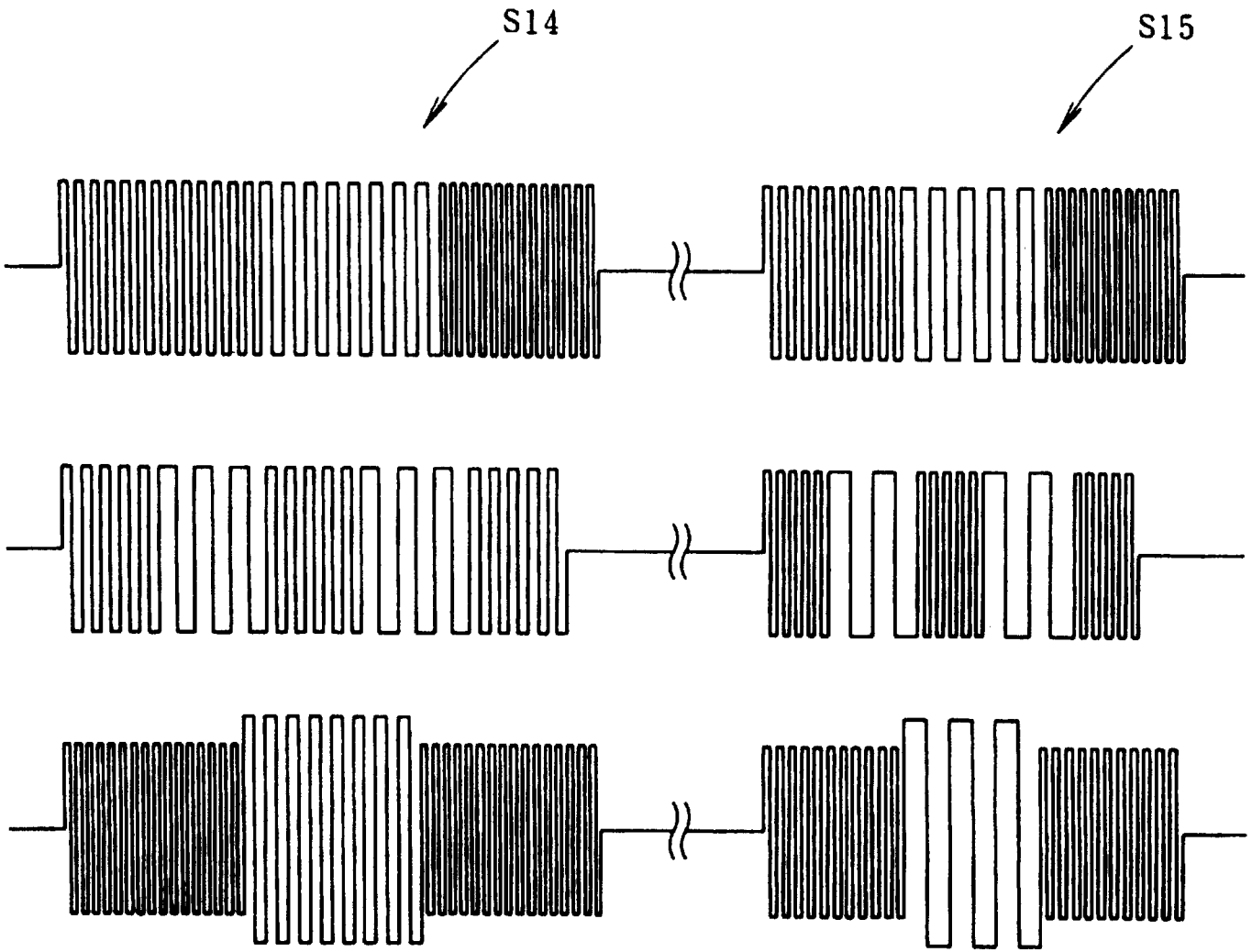
FIGS. 7A to 7C are diagrams showing modifications of the first and second synthetic signals.

The case where the three rectangular wave signals s5, s6, and s7 constructing the first and second synthetic signals s14 and s15 have the same amplitude and their frequencies are arranged in the order of high-low-high has been described in the foregoing embodiment. However, as shown in FIGS. 7A and 7B, the frequency components of the rectangular wave signals may be changed as appropriate in accordance with the frequency characteristics of the speaker 16 and the like, and the amplitudes of the rectangular wave signals may be set to different values as shown in FIG. 7C. An artificial striking sound which is even closer in sound to the striking sound of the mechanical relay can be thus obtained.

As mentioned above, not only the rectangular wave but also a triangular wave or a sine wave can also be used as the signal waveform. In the case of using other waveforms, the oscillation circuits 26, 28, and 30 in FIG. 4 are replaced with oscillation circuits for a triangular wave or a sine wave, and an operational amplifier or an analog switch may be used as the signal synthesizing circuit 32.

Although the rectangular wave signals s5, s6, and s7 are synthesized without any pause in the foregoing embodiment, pauses may be made between rectangular wave signals. In this case, the pause is desirably n/2 (n is an integer) of each signal cycle.

Figure 8:
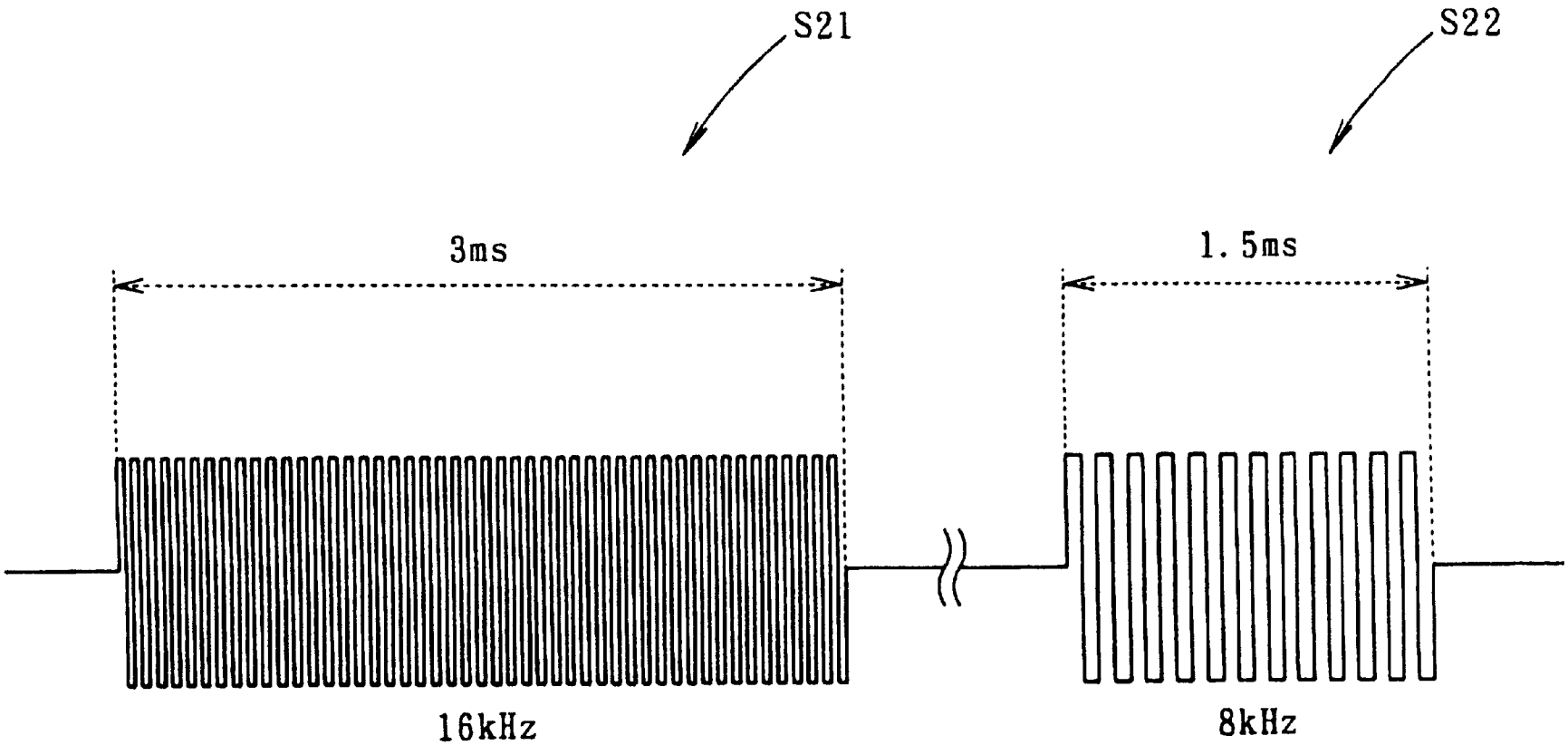
FIG. 8 is a diagram showing a modification of the foregoing embodiment.
Figure 9:
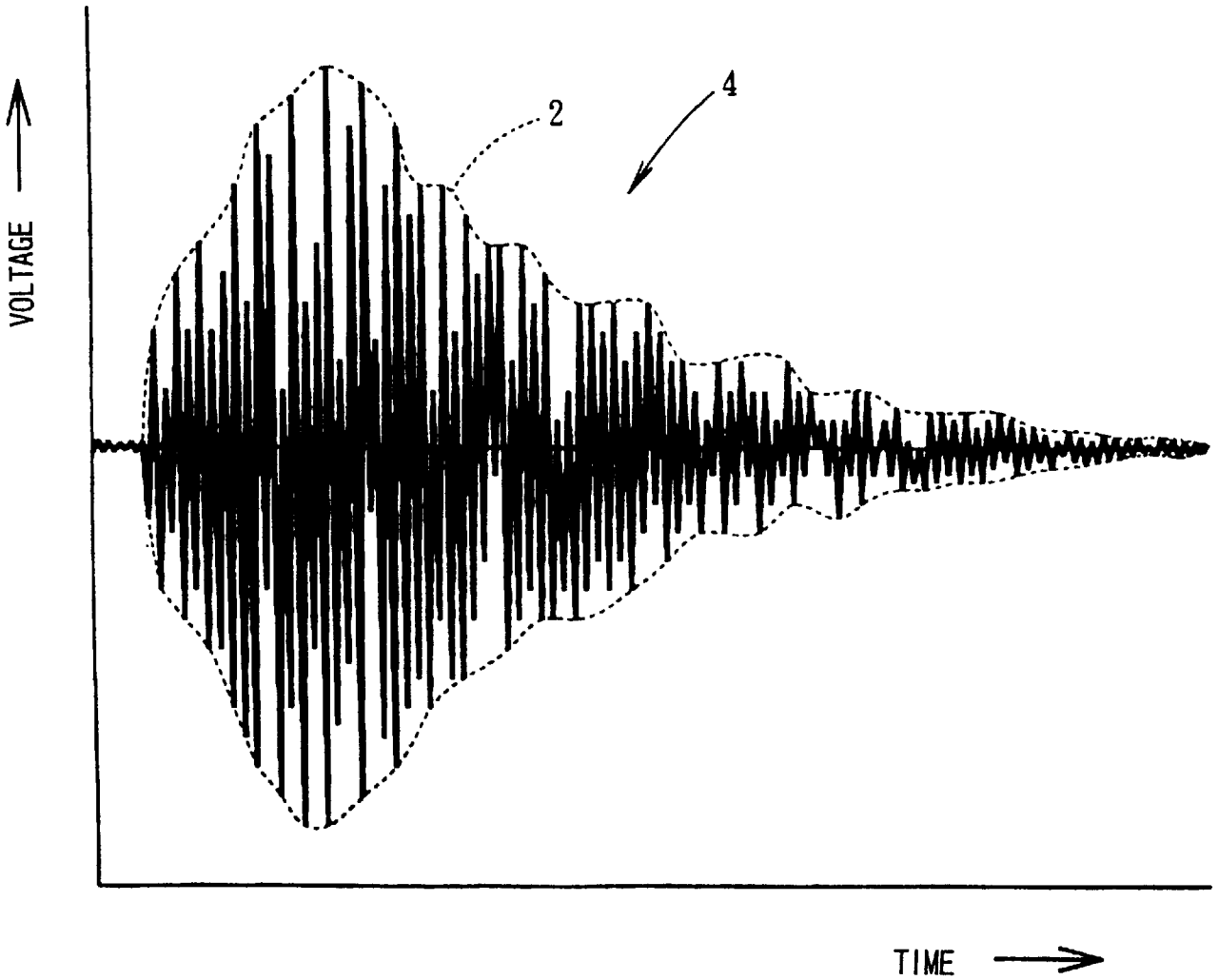
FIG. 9 is a waveform chart showing an example of a driving signal to faithfully reproduce the striking sound of the mechanical relay.

Further, in the embodiment the first and second synthetic signal generating circuits 20A and 20B generate the first and second synthetic signals s14 and s15 by synthesizing a plurality of rectangular wave signals having different frequencies. In place of the first and second synthetic signal generating circuits 20A and 20B, for example, first and second signal generating circuits for generating first and second rectangular wave signals s21 and s22 having different frequencies and different durations as shown in FIG. 8 can be also used.

In the case of adopting such a construction, two kinds of rectangular wave signals s21 and s22 generated by the first and second signal generating circuits are alternately outputted from a signal output circuit replacing the synthetic signal output circuit 22 synchronously with the timing of the turn-on and turn-off of the turn signal indicator, and two kinds of artificial striking sounds are alternately generated from the speaker 16. Even if each of the artificial striking sounds is not similar to the striking sound of the mechanical relay, since the generation pattern of the artificial string sound is the same as that of the flashing operation sound of the turn signal indicator which is the striking sound of the mechanical relay, the flashing operation sound of the turn signal indicator can be prevented from sounding unusual to the driver. By adopting such a construction, the construction of the sounding-body driving circuit can be made simpler and cheaper.

On the contrary, a synthetic signal obtained by synthesizing a plurality of rectangular wave signals having different frequencies is used as the signal itself outputted from the sounding-body driving circuit, and one kind of synthetic signals can be repeatedly outputted synchronously with the timing of the turn-on and turn-off of the turn signal indicator.

In the case of adopting such a construction, the tone of the artificial striking sound generated from the speaker 16 based on the synthetic signal can be made similar to that of at least one of the two kinds of striking sounds generated by the mechanical relay. By generating the artificial striking sound in the same pattern as the generation pattern of the flashing operation sound of the turn signal indicator which is the striking sound of the mechanical relay, the flashing operation sound of the turn signal indicator can be prevented from sounding unusual to the driver. By adopting the construction, it is sufficient to use a single synthetic signal generating circuit, so that the sounding-body driving circuit can have a further simpler and cheaper construction.

The first synthetic signal generating circuit 20A (or the second synthetic signal generating circuit 20B) constructing a part of the sounding-body driving circuit 12 of the embodiment is constructed so as to generate the synthetic signal s14 (or s15) used as the artificial striking sound driving signal. It can be used not only for obtaining the flashing operation sound of the turn signal indicator by repeatedly generating the artificial striking sound at intervals of a predetermined time as the operation sound generating apparatus of the turn signal indicator, but also in various fields where the artificial striking sound is necessary.

The case where the plurality of oscillation circuits are provided and the synthetic signal is generated by connecting the signals generated by the oscillation circuits in sequence of time has been described in the foregoing embodiment. However, it is also possible to generate a synthetic signal by generating two or more kinds of signals of frequencies by a single oscillation circuit and changing the frequencies of the signals to be generated with elapse of time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An apparatus comprising:

a sounding-body driving signal generating circuit for generating an artificial striking sound driving signal, said sounding-body driving signal generating circuit including:

a synthetic signal generating circuit for generating a plurality of signals each having a frequency, wherein at least two of said signals have frequencies different from each other, and for sequentially connecting said signals over a continuous period of time so as to generate a synthetic signal; and a synthetic signal output circuit for repeatedly outputting said synthetic signal at intervals of a predetermined period of time as said driving signal.

2. The apparatus of claim 1, wherein said synthetic signal generating circuit includes a plurality of oscillation circuits for generating a plurality of rectangular wave signals each having a frequency, wherein at least two of said rectangular wave signals have frequencies different from each other.

3. The apparatus of claim 2, wherein said synthetic signal generating circuit further includes a signal synthesizing circuit for sequentially connecting said rectangular wave signals over a continuous period of time so as to generate a synthetic signal having a duration of no greater than 12 ms.

4. The apparatus of claim 1, wherein said synthetic signal generating circuit is operable to sequentially connect said signals over a continuous period of time so as to generate a synthetic signal having a duration of no greater than 12 ms.

5. The apparatus of claim 1, wherein said synthetic signal generating circuit comprises a first synthetic signal generating circuit for generating a first synthetic signal, said sounding-body driving signal generating circuit further including:

a second synthetic signal generating circuit for generating a plurality of second signals each having a frequency, wherein at least two of said second signals have frequencies different from each other, and for sequentially connecting said second signals over a continuous period of time so as to generate a second synthetic signal; and wherein said synthetic signal output circuit is operable to alternately output said first synthetic signal and said second synthetic signal as said driving signal.

6. The apparatus of claim 5, further comprising:

a sounding body connected to said sounding-body driving signal generating circuit, said sounding body being operable to:

receive said driving signal output from said sounding-body driving signal generating circuit; and generate an artificial striking sound based on said driving signal.

7. The apparatus of claim 1, wherein said sounding-body driving signal generating circuit is operable to generate an artificial striking sound driving signal based on an operation of a turn signal indicator, said sounding-body driving signal generating circuit being operable to repeatedly output said synthetic signal as said driving signal synchronously with a turning-on operation and a turning-off operation of the turn signal indicator.

8. The apparatus of claim 7, further comprising:

a sounding body connected to said sounding-body driving signal generating circuit, said sounding body being operable to:

receive said driving signal output from said sounding-body driving signal generating circuit; and generate an artificial striking sound based on said driving signal.

9. The apparatus of claim 1, further comprising:

a sounding body connected to said sounding-body driving signal generating circuit, said sounding body being operable to:

receive said driving signal output from said sounding-body driving circuit; and generate an artificial striking sound based on said driving signal.

10. The apparatus of claim 1, wherein said sounding-body driving signal generating circuit is operable to generate an artificial striking sound driving signal based on an operation of a turn signal indicator, said sounding-body driving signal generating circuit further including a leading edge detecting circuit for detecting a leading edge of a direction indication control signal received from the turn signal indicator, for generating a pulse signal when said leading edge is detected, and for transmitting said pulse signal to said synthetic signal generating signal, said synthetic signal generating circuit being operable to generate said synthetic signal based on said pulse signal.

11. An apparatus comprising:

a plurality of oscillation circuits, each of said oscillation circuits being operable to generate a wave signal having a frequency, wherein at least two of said oscillation circuits generate respective wave signals having frequencies different from each other, a signal synthesizing circuit for sequentially connecting said wave signals over a continuous period of time so as to generate a synthetic signal; and a synthetic signal output circuit for repeatedly outputting said synthetic signal at intervals of a predetermined period of time as an artificial striking sound driving signal.

12. The apparatus of claim 11, wherein each of said oscillation circuits is operable to generate a rectangular wave signal having a frequency.

13. The apparatus of claim 12, wherein said signal synthesizing circuit is operable to sequentially connect said rectangular wave signals over a continuous period of time so as to generate a synthetic signal having a duration of no greater than 12 ms.

14. The apparatus of claim 11, wherein said signal synthesizing circuit is operable to sequentially connect said wave signals over a continuous period of time so as to generate a synthetic signal having a duration of no greater than 12 ms.

15. The apparatus of claim 11, wherein said plurality of oscillation circuits comprises a plurality of first oscillation circuits for generating a plurality of first wave signals, and wherein signal synthesizing circuit comprises a first signal synthesizing circuit for sequentially connecting said first wave signals over a continuous period of time so as to generate a first synthetic signal, further comprising:

a plurality of second oscillation circuits, each of said second oscillation circuits being operable to generate a second wave signal having a frequency, wherein at least two of said second oscillation circuits generate respective second wave signals having frequencies different from each other; and a second signal synthesizing circuit for sequentially connecting said second wave signals over a continuous period of time so as to generate a second synthetic signal;

wherein said synthetic signal output circuit is adapted to alternately output said first synthetic signal and said second synthetic signal as said driving signal.

16. The apparatus of claim 11, wherein said sounding-body driving signal generating circuit is operable to generate an artificial striking sound driving signal based on an operation of a turn signal indicator, said synthetic signal output circuit being operable to repeatedly output said synthetic signal as said driving signal based on a direction indication control signal received from the turn signal indicator.

17. The apparatus of claim 16, further comprising:

a sounding body connected to said synthetic signal output circuit, said sounding body being operable to:

receive said driving signal output from said synthetic signal output circuit; and generate an artificial striking sound based on said driving signal.

18. The apparatus of claim 11, further comprising:

a sounding body connected to said synthetic signal output circuit, said sounding body being operable to:

receive said driving signal output from said synthetic signal output circuit; and generate an artificial striking sound based on said driving signal.

19. The apparatus of claim 11, wherein said sounding-body driving signal generating circuit is operable to generate an artificial striking sound driving signal based on an operation of a turn signal indicator, the apparatus further comprising:

a leading edge detecting circuit for detecting a leading edge of a direction indication control signal received from the turn signal indicator, and for generating a pulse signal when said leading edge is detected; and a timing control signal generating circuit for receiving said pulse signal from said leading edge detecting circuit, for generating a plurality of trigger signals based on said pulse signal, and for transmitting each of said trigger signals to a respective one of said oscillation circuits, each of said oscillation circuits being operable to generate said respective wave signal based on said trigger signal.

20. An apparatus comprising:

a sounding-body driving signal generating circuit for generating an artificial striking sound driving signal, said sounding-body driving signal generating circuit including:

a plurality of oscillation circuits for generating wave signals each having a frequency, wherein at least two of said wave signals have frequencies different from each other; and a signal synthesizing circuit for sequentially connecting said wave signals over a continuous period of time so as to generate a synthetic signal;

a synthetic signal output circuit for repeatedly outputting said synthetic signal at intervals of a predetermined period of time as said driving signal.

21. The apparatus of claim 20, wherein said oscillation circuits are operable to generate a plurality of rectangular wave signals each having a frequency.

22. The apparatus of claim 21, wherein said signal synthesizing circuit is operable to sequentially connect said rectangular wave signals over a continuous period of time so as to generate a synthetic signal having a duration of no greater than 12 ms.

23. The apparatus of claim 20, wherein said signal synthesizing circuit is operable to sequentially connect said signals over a continuous period of time so as to generate a synthetic signal having a duration of no greater than 12 ms.

24. The apparatus of claim 20, wherein said sounding-body driving signal generating circuit is operable to generate an artificial striking sound driving signal based on an operation of a turn signal indicator, said sounding-body driving signal generating circuit further including:

a leading edge detecting circuit for detecting a leading edge of a direction indication control signal received from the turn signal indicator, and for generating a pulse signal when said leading edge is detected; and a timing control signal generating circuit for receiving said pulse signal from said leading edge detecting circuit, for generating a plurality of trigger signals based on said pulse signal, and for transmitting each of said trigger signals to a respective one of said oscillation circuits, each of said oscillation circuits being operable to generate said respective wave signal based on said trigger signal.

* * * * *